US007669930B2

(12) United States Patent
Hsu

(10) Patent No.: US 7,669,930 B2
(45) Date of Patent: Mar. 2, 2010

(54) LOCKABLE PRESSURE ADJUSTMENT SEAT OF A FITNESS APPARATUS

(76) Inventor: Long-chuan Hsu, No. 39, Sha Luen, Chung Sha Vill., An Din Hsiang, Tainan Hsien (TW)

( * ) Notice: Subject to any disclaimer, the term of this patent is extended or adjusted under 35 U.S.C. 154(b) by 761 days.

(21) Appl. No.: 11/543,806

(22) Filed: Oct. 6, 2006

(65) Prior Publication Data

US 2008/0096729 A1 Apr. 24, 2008

(51) Int. Cl.
*B60N 2/10* (2006.01)
*B60N 2/38* (2006.01)
*B60N 2/40* (2006.01)
*B62J 1/02* (2006.01)

(52) U.S. Cl. ..... 297/362.13; 297/363; 297/364; 297/376; 297/195.1; 297/195.11

(58) Field of Classification Search ..... 297/362.13, 297/363, 364, 365, 376, 195.1, 195.11
See application file for complete search history.

(56) References Cited

U.S. PATENT DOCUMENTS 3,157,433 A * 11/1964 Davis ..... 297/364 X
3,286,971 A * 11/1966 Johannes et al. ..... 297/363 X
3,533,658 A * 10/1970 Gropp ..... 297/362.13
3,744,844 A * 7/1973 Nomaki et al. ..... 297/362.13
6,688,694 B1 * 2/2004 Yu ..... 297/362.13
6,715,834 B1 * 4/2004 Liao ..... 297/362.13
6,951,370 B1 * 10/2005 Hsu ..... 297/362.13 X
7,296,857 B2 * 11/2007 Shinozaki et al. ..... 297/365
7,311,359 B2 * 12/2007 Smith ..... 297/362.13 X

* cited by examiner

*Primary Examiner*—Rodney B White
(74) *Attorney, Agent, or Firm*—Rosenberg, Klein & Lee

(57) ABSTRACT

A lockable pressure adjustment seat of a fitness apparatus includes a base, a seat back, and an adjustment unit. The base is disposed with a slide track and a locating hole. The seat back is pivotally connected to the base. The seat back includes an extension rod. One end of the extension rod is linked and fixed to the seat back. A through hole is disposed adjacent to the other end of the extension rod. The adjustment unit includes a lever, a pressure bar, and a locking set. The lever penetrates the slide track. The pressure bar includes a push rod and a fixation base. The push rod holds against the lever. The fixation base is secured to the other end of the extension rod. The locking set is fixed to the fixation base, and comprises an elastic member and a locating rod.

4 Claims, 6 Drawing Sheets

LOCKABLE PRESSURE ADJUSTMENT SEAT OF A FITNESS APPARATUS

BACKGROUND OF THE INVENTION (a) Field of the Invention

The present invention relates to a lockable pressure adjustment seat of a fitness apparatus, and more particularly, to one allow separate operation of angle adjustment and locking to improve locking safety.

(b) Description of the Prior Art

The seat back of a seat adapted to a fitness apparatus is usually can be adjusted for its inclination as desired by the individual user. A conventional seat back adjustment comprises a pressure bar disposed to the bottom of a cushion of the seat. The pressure bar is linked to the seat back. An adjusting handle is provided to control the pressurization and pressure release of the pressure bar so as to adjust the inclination of the seat back. Once the desired inclination is attained, the seat back is secured in position by turning the handle.

The prior art operates on the pressure bar to adjust the inclination of the seat back and the inclination is secured in position also by operating the pressure bar; that is, the adjustment and the positioning of the seat back is done by the same handle in the prior art. When the user is sitting on the seat of the fitness apparatus, he/she may touch the handle by accident to release the pressure bar and the seat back immediately goes for automatic adjustment; so that the user can be easily hurt by the seat back or having his/her muscle strained by sudden exertion of force.

SUMMARY OF THE INVENTION

The primary purpose of the present invention is to provide a lockable pressure adjustment seat adapted to a fitness apparatus by separating the adjustment of the inclination of the seat back and the locking of the inclination after adjustment without risking the accidental touch of a handle.

To achieve the purpose, the present invention comprises a base, a seat back, and an adjustment unit. A slide track is disposed close to one end of the base and a locating hole is provided close to another end of the base. The seat back comprises an extension rod. One end of the extension rod is fixed and linked to the seat back, and a through hole is provided adjacent to the other end of the extension rod. The adjustment unit comprises a lever, a pressure bar and a locking set. The lever penetrates through and slides on the slide track of the base. The pressure bar includes a push rod extending from a front end of the pressure bar and a fixation base disposed at a rear end of the pressure bar. The push rod of the pressure bar holds against the lever. The fixation base is fixed to the other end of the extension rod, and the locking set is secured to the fixation base. The locking set includes an elastic member and a locating rod. The elastic member pushes the locating rod to penetrate through the through hole of the extension rod and further into the locating hole of the base to be secured in position.

Accordingly, by pulling the locating rod for it to clear off the locating hole of the base, the seat back can be adjusted by pressing the lever to move the push rod, and then the locating rod is released for it to be secured in the locating hole of the base when the desired inclination of the seat back is attained.

The slide track comprises two slots provided in parallel to each other to accommodate the lever to slide therein. The push rod of the pressure bar penetrates through the slots with its front end to hold against the lever.

A lateral pin is disposed at a middle section of the locating rod and. A groove is disposed in the through hole of the extension rod. A protruding ring is provided at a front section of the locating rod. One end of the elastic member holds against the protruding ring and the other end of the elastic member holds against the extension rod. By rotating the locating rod, the lateral pin passes through the groove.

Accordingly, the present invention respectively adjusts the inclination of the seat back and locks up the inclination by means of the adjustment unit composed of the lever and the locking set to avoid accidental touch of the handle to achieve safe operation of the fitness apparatus.

DETAILED DESCRIPTION OF THE PREFERRED EMBODIMENTS

Figure 1:
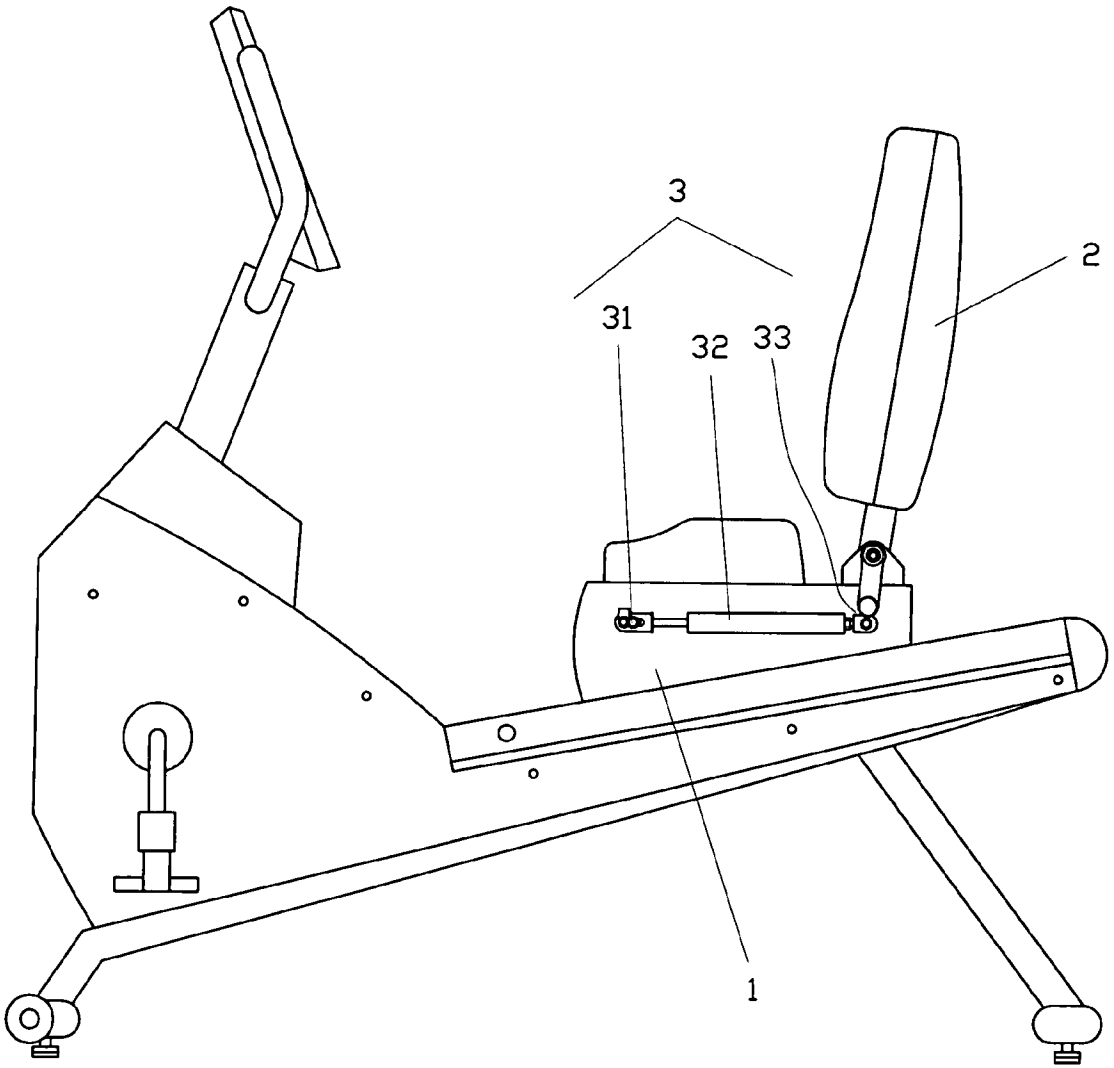
FIG. 1 is a side view of a preferred embodiment of the present invention.

Referring to FIG. 1, a preferred embodiment of the present invention comprises a base (1), a seat back (2), and an adjustment unit (3). The base (1) is pivotally connected with the seat back (2).

Figure 2:
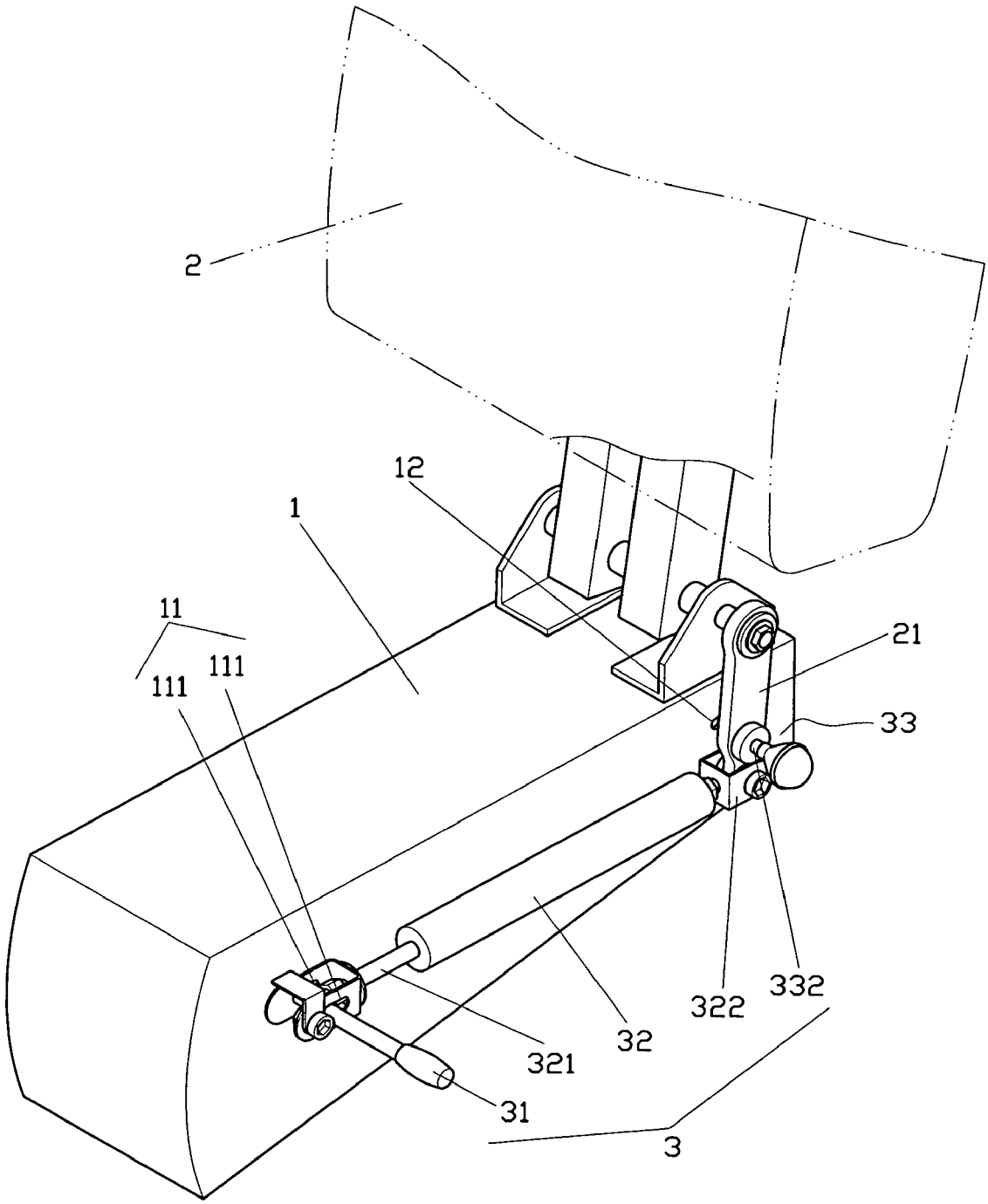
FIG. 2 is a perspective view of an adjustment unit of the preferred embodiment of the present invention.

As illustrated in FIGS. 2 through 5, the base (1) comprises a slide track (11) disposed close to one end of the base (1) and a locating hole (12) disposed close to the other end of the base (1). The slide track (11), as illustrated in FIG. 2, comprises two slots (111) disposed in parallel to each other.

The seat back (2) comprises an extension rod (21). One end of the extension rod (21) is linked and fixed to the seat back (2). In this preferred embodiment, the seat back (2) is pivotally connected to the base (1) with a pivot and one end of the extension rod (21) is fixed to the end of the pivot. A through hole (211) is disposed adjacent to the other end of the extension rod (21). A groove (212) is disposed in the through hole (211).

The adjustment unit (3) comprises a lever (31), a pressure bar (32), and a locking set (33). The lever (31) penetrates and slides in the slide track (11) of the base (1), i.e., the lever (31) penetrates the slots (111) at the same time. The pressure bar (32) comprises a push rod (321) extending from a front end of the pressure bar (32) and a fixation base (322) disposed at a rear end of the pressure bar (32). The front end of the push rod (321) extending from the pressure bar (32) penetrates through the slide track (11) between the slots (111) to hold with its front end against the lever (31), while the fixation base (322) of the pressure bar (32) is fixed to the other end of the extension rod (21) close to the through hole (211). The locking set (33) is fixed to the fixation base (322). The locking set (33) comprises an elastic member (331) and a locating rod (332). A protruding ring (334) is provided at a front section of the locating rod (332), and the front end of the locating rod (332)

is a pillar end (335). One end of the elastic member (331) holds against the protruding ring (334), and the other end of the elastic member (331) holds against the extension rod (21). The elastic member (331) pushes the locating rod (332) to penetrate through the through hole (211) of the extension rod (21) with the pillar end (335) holding against the locating hole (12) of the base (1) to be secured in place. A lateral pin (333) disposed at a middle section of the locating rod (332) passes through the groove (212).

Figure 3:
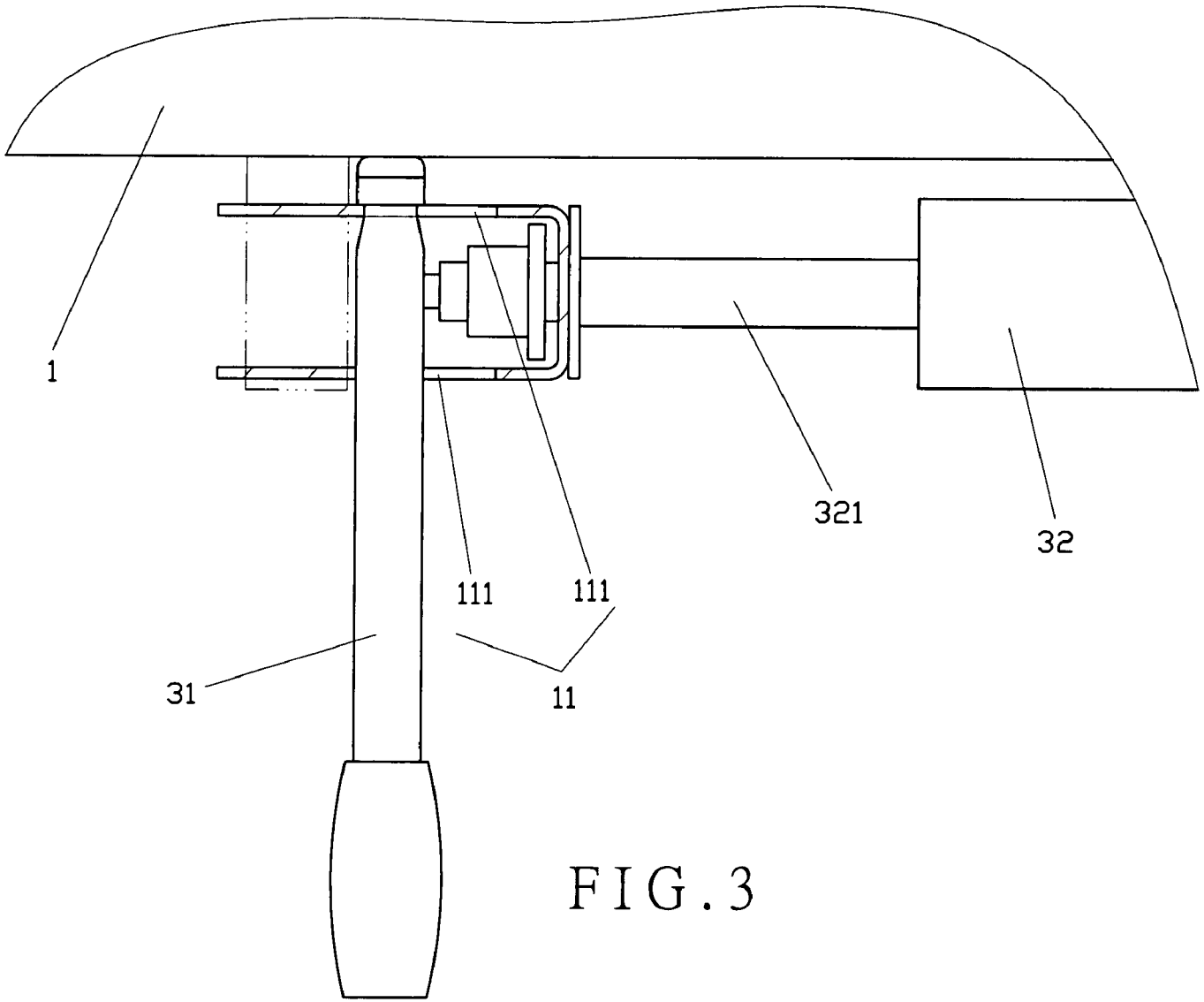
FIG. 3 is a top view showing the operation of a lever of the adjustment unit of the preferred embodiment of the present invention.
Figure 4:
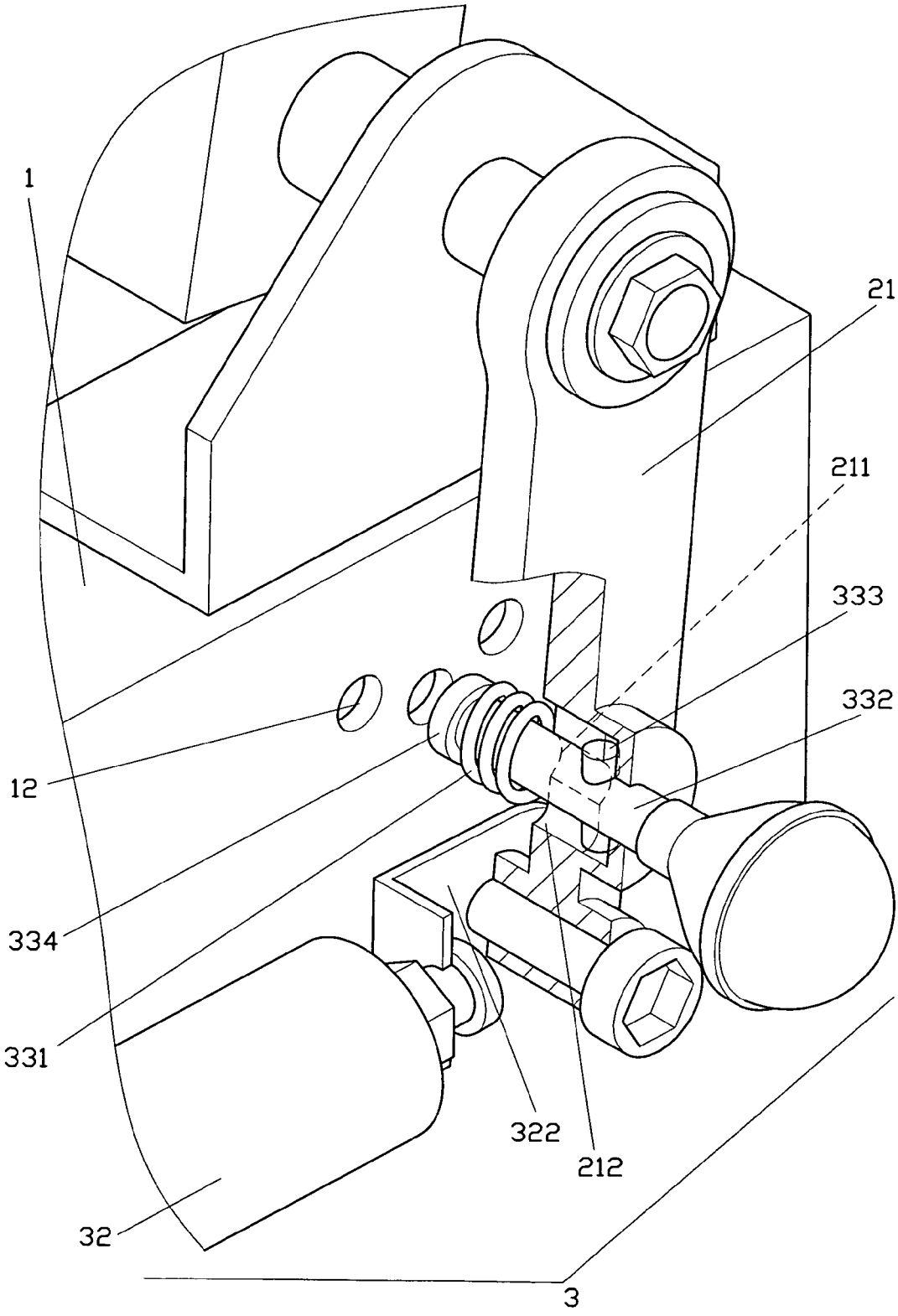
FIG. 4 is an enlarged view [sectional view of a local part] of a locking set of the adjustment unit of the preferred embodiment of the present invention.
Figure 5:
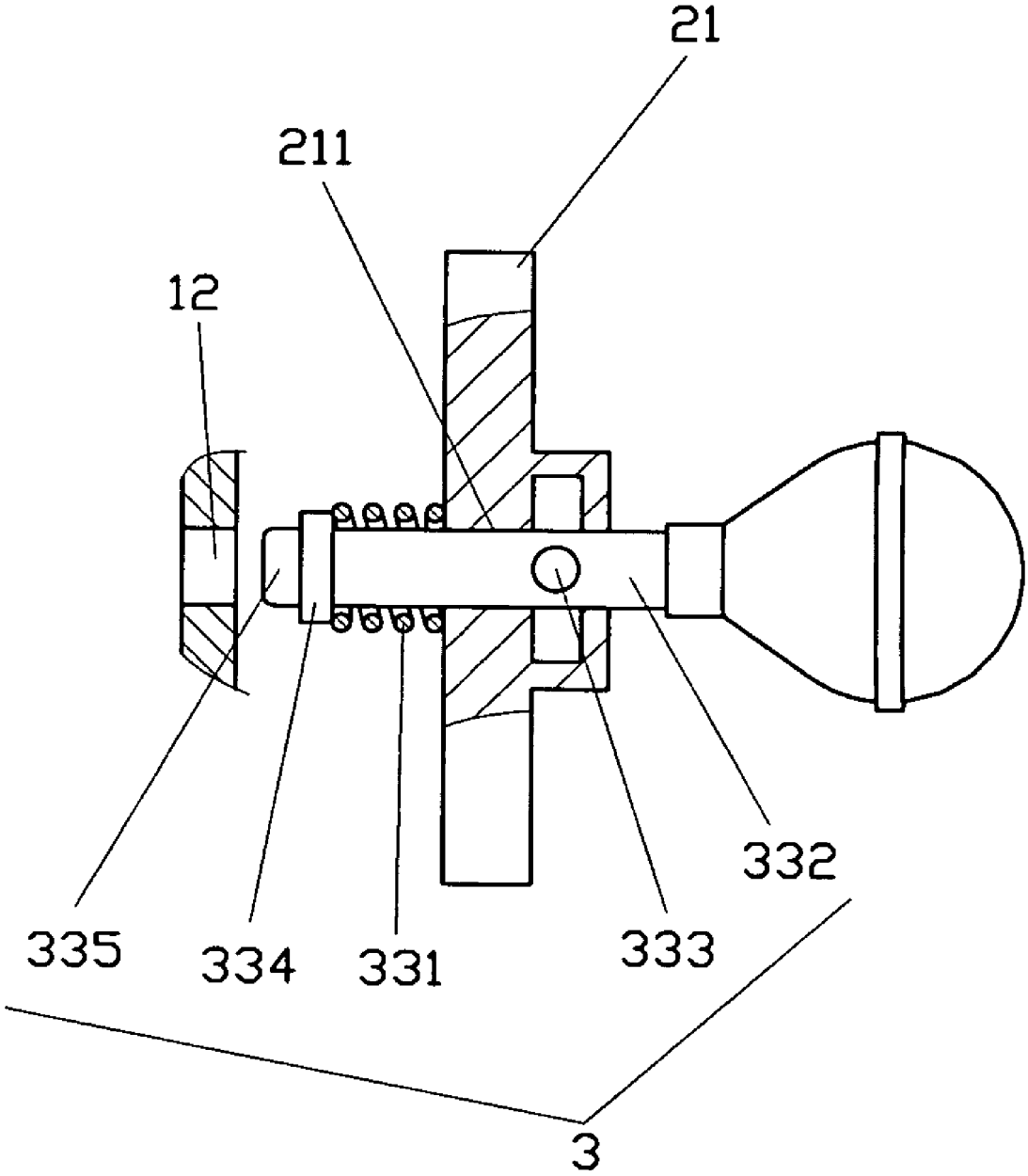
FIG. 5 is a top view [sectional view of a local part] showing the operation of the locking set of the adjustment unit of the preferred embodiment of the present invention.

In making the adjustment of the inclination of the seat back as illustrated in FIGS. 2, 3, and 5, the locating rod (332) is pulled out for the pillar end (335) to clear off the locating hole (12) of the base (1). The lateral pin (333) of the locating rod (332) passes through the groove (212). The lateral pin (333) is locked in the through hole (211) of the extension rod (21) by rotating the locating rod (332) so as to adjust the seat back (1) by pressing the lever (31) to move the push rod (321), and then lateral pin (333) passes through once again the groove (212) by rotating the locating rod (332) so as to release the locating rod (332) for it to hold against the locating hole (12) of the base (1) to be secured in place.

Figure 6:
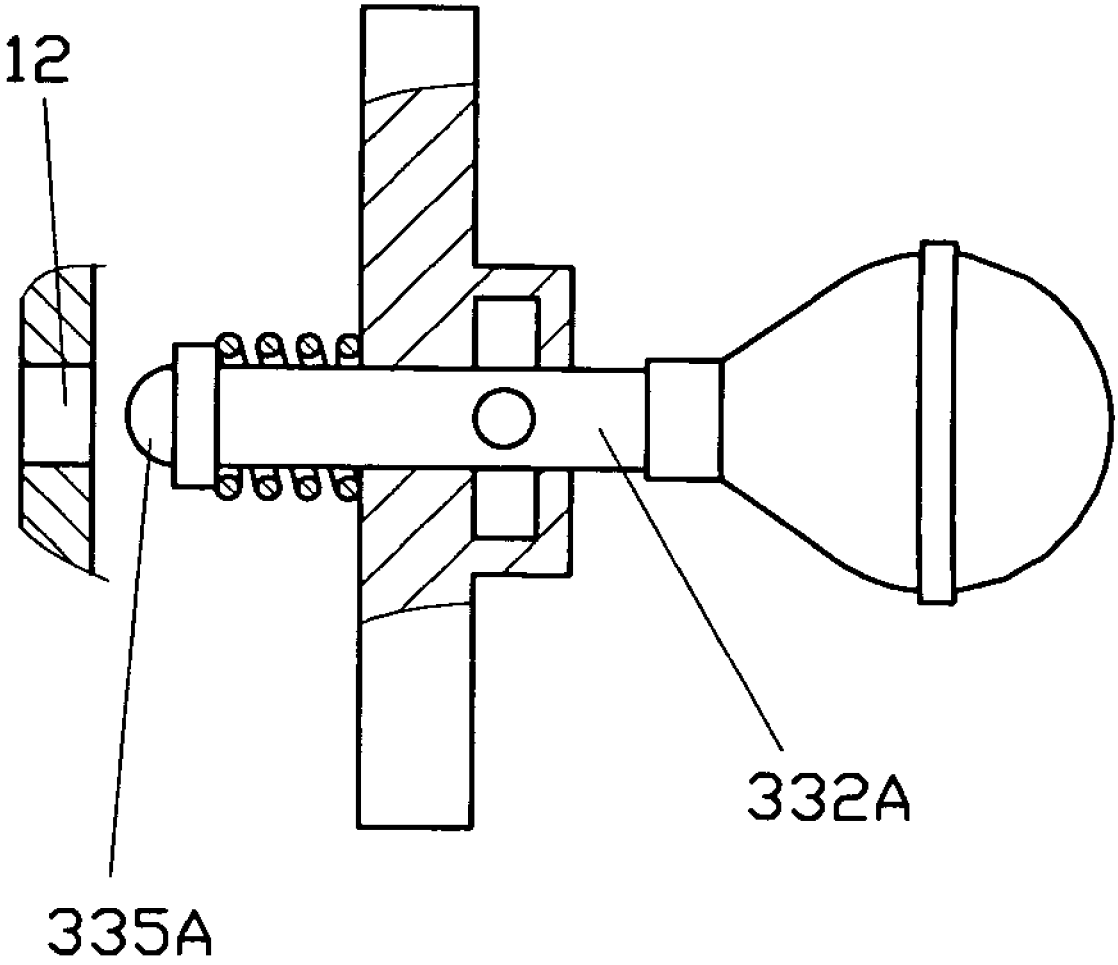
FIG. 6 is a top view of a locating rod of another preferred embodiment of the present invention.

Now referring to FIG. 6 for another preferred embodiment of the present invention, the front end of a locating rod (332A) is a ball end (335A). The locating rod (332A) provides proper security even if the user operates the adjustment unit by mistake. In practice, it is not necessary for the user to pull the locating rod (332A) under normal operating condition. The user may lean back against the seat back, and the ball end (335A) will clear off the locating hole (12). However, the locating rod (332A) will be slightly locked before the ball end (335A) to clear off the locating hole (12) thus to warn the user if he exerts more pressure against the seat back, the seat back will get loosened up.

What is claimed is:

1. A lockable pressure adjustment seat of a fitness apparatus comprising a base, a seat back, and an adjustment unit, wherein the base is pivotally connected with the seat back;

the base comprising a slide track disposed close to one end of the base and a locating hole disposed close to another end of the base;

the seat back comprising an extension rod, the extension rod having one end linked and fixed to the seat back and a through hole being disposed at the other end of the extension rod;

the adjustment unit comprising a lever, a pressure bar, and a locking set, the lever penetrating through and sliding in the slide track of the base, the pressure bar extending from its front end a push rod and disposed at its rear end a fixation base, the push rod having a front end holding against the lever, the fixation base being secured to the other end of the extension rod, the locking set being secured to the fixation base and including an elastic member and a locating rod, the elastic member pushing the locating rod to penetrate through the through hole of the extension rod to be held in position in the locating hole of the base; the locating rod being pulled out to clear off the locating hole of the base so as to adjust the seat back by pressing the lever to move the push rod, and then the locating rod being released to hold against the locating hole of the base to be secured in position;

the locating rod having a lateral pin provided at a middle section thereof, a groove being disposed in the through hole of the extension rod, a protruding ring being provided at a front section of the locating rod, the elastic member having one end to hold against the protruding ring and another end to hold against the extension rod, the lateral pin passing through the groove by turning the locating rod.

2. The lockable pressure adjustment seat of a fitness apparatus as claimed in claim 1, wherein the slide track of the base comprises two slots in parallel to each other, the lever penetrating and sliding in the two slots of the slide track, the push rod of the pressure bar penetrating the slide track between the slots with its front end to hold against the lever.

3. The lockable pressure adjustment seat of a fitness apparatus as claimed in claim 1, wherein the locating rod has a front end which is a pillar end.

4. The lockable pressure adjustment seat of a fitness apparatus as claimed in claim 1, wherein the locating rod has a front end which is a ball end.

* * * * *